US005534181A

United States Patent [19]

Henkel et al.

[11] Patent Number: 5,534,181

[45] Date of Patent: Jul. 9, 1996

[54] AQUEOUS HARD SURFACE CLEANING COMPOSITIONS HAVING IMPROVED CLEANING PROPERTIES

[75] Inventors: Herbert W. Henkel, East Hanover; Elisabeth Kaplan, Oceanport, both of N.J.; Philip G. Hall, Oxford, United Kingdom

[73] Assignee: Castrol North America Automotive Inc., Wayne, N.J.

[21] Appl. No.: 521,520

[22] Filed: Aug. 30, 1995

Related U.S. Application Data

[60] Provisional application No. 60/002,192, Aug. 11, 1995.

[51] Int. Cl.[6] ..... C11D 1/66; C11D 3/04; C11D 3/32; C11D 3/22

[52] U.S. Cl. ..... 510/423; 510/420; 510/433; 510/488; 510/502; 510/506; 510/245

[58] Field of Search ..... 252/111, 525, 252/139, 544, 153, 158, 173, 174.17, 174.21

[56] References Cited

U.S. PATENT DOCUMENTS

| | | | |
|---|---|---|---|
| 3,031,409 | 4/1962 | Perlman et al. | 252/158 |
| 3,887,497 | 6/1975 | Ulvild | 252/526 |
| 3,960,742 | 6/1976 | Leonard | 252/90 |
| 4,060,496 | 11/1977 | Berliner | 252/171 |
| 4,161,452 | 7/1979 | Stambaugh et al. | 252/34 |
| 4,528,039 | 7/1985 | Rubin et al. | 134/2 |
| 4,746,453 | 5/1988 | Chen et al. | 252/135 |
| 4,863,629 | 9/1989 | Osberghaus et al. | 252/162 |
| 4,931,102 | 6/1990 | Burke | 134/2 |
| 5,234,505 | 8/1993 | Winston et al. | 134/40 |
| 5,252,245 | 10/1993 | Garabedian, Jr. et al. | 252/153 |
| 5,364,551 | 11/1994 | Lentsch et al. | 252/156 |
| 5,376,297 | 12/1994 | Choy et al. | 252/108 |

OTHER PUBLICATIONS

Kirk–Othmer Encyclopedia of Chemical Technology, (3d ed. 1983), vol. 22, pp. 360–377. (no month available).

Westley's Material Safety Data Sheet, *Westley's Clear Magic*, Mar. 15, 1989.

Dow Brands, Westley's Material Safety Data Sheet, Fantastik®, Apr. 1, 1992.

Westley's Knight Oil Corporation, Material Safety Data Sheet, Grez–Off®, Aug. 6, 1991.

*Primary Examiner*—Erin M. Harriman

*Attorney, Agent, or Firm*—McAndrews, Held & Malloy, Ltd.

[57] ABSTRACT

The invention pertains to non-corrosive aqueous hard surface cleaning compositions having improved cleaning performance, said cleaning compositions comprising from about 0.4% to about 5% of an alkali metal salt; from about 0.3% to about 4% of a nonionic fatty acid amide; from about 0.3% to about 4% of an iso-fatty acid; from about 2% to about 7% of a builder; from about 1% to about 15% of a glycol ether; from about 1% to about 15% of a nonionic surfactant; and from about 50% to about 95% water. The invention may have additional ingredients, including colorants and fragrants, which do not obviate the cleaning performance of the invention.

27 Claims, No Drawings

AQUEOUS HARD SURFACE CLEANING COMPOSITIONS HAVING IMPROVED CLEANING PROPERTIES

CROSS-REFERENCE TO RELATED APPLICATIONS

Priority is claimed from provisional application U.S. Ser. No. 60/002,192, Attorney Docket No. 10927US01, filed Aug. 11, 1995, by Herbert W. Henkel, Elisabeth Kaplan, and Philip Hall, now pending. The entire specification and all the claims of the provisional application referred to above are hereby incorporated by reference to provide continuity of disclosure.

BACKGROUND OF THE INVENTION

The invention pertains to aqueous hard surface cleaning compositions, and particularly to noncorrosive hard surface cleaning compositions providing improved soil removal.

Safely cleaning hard surfaces has proven to be troublesome. Although corrosive alkaline cleaning solutions are fairly effective in removing dirt, sludges, greases, oils and other soil, they are subject to restrictive regulations by the Department of Transportation and by the Consumer Product Safety Commission under the Federal Hazardous Substances Act. ("Corrosive" is defined by these regulations.) Many non-corrosive cleaning products fail to remove significant percentages of soil from the hard surfaces to which they are applied. Non-corrosive cleaning solutions may require multiple applications or vigorous manual action to succeed in removing a satisfactory amount of soil.

Prior attempts have been made to maximize the cleansing effectiveness of non-corrosive cleaning agents through the inclusion of various surfactants, solvents and/or additional elements. These prior attempts have failed to employ the optimal proportions of components which yield the best cleaning performance.

SUMMARY OF THE INVENTION

An object of the present invention is to provide a non-corrosive aqueous alkaline cleaning composition with improved cleaning properties.

A further object of the present invention is to provide an improved cleaning solution which is particularly suitable for cleaning hard surfaces.

Additional objects will be apparent to one skilled in the art from the following description of the present invention.

The present invention is a cleaning composition comprising from about 0.4% to about 5% of an alkali metal salt; from about 0.3% to about 4% of a nonionic fatty acid amide; from about 0.3% to about 4% of an iso-fatty acid; from about 2% to about 7% of a builder; from about 1% to about 15% of a glycol ether; from about 1% to about 15% of a nonionic surfactant; and from about 50% to about 95% water. Additional components may also be included in this cleaning composition.

One of the advantages of the present invention over prior non-corrosive cleaning compositions is the improved cleaning performance of the present invention. Additional benefits will be apparent to one skilled in the art from the description below.

DETAILED DESCRIPTION OF THE INVENTION

The present invention, which addresses one or more of these objects, is a composition of matter having the ingredients and proportions recited above in the summary.

The present invention comprises from about 0.4% to about 5%, alternatively from about 1% to about 2%, alternatively about 1.5%, of one or more alkali metal gluconates. (Generally speaking, the term "alkali metal" as used in the specification and the claims means lithium, sodium, potassium, rubidium and cesium. Also, throughout the specification and the claims, the amounts of the components are listed in percentages by weight of the total composition, unless otherwise indicated.) In addition to contributing to the overall cleaning performance of the present invention, the alkali metal gluconate may act as a metal protector, thereby reducing corrosion when the cleaning composition is used on metal surfaces, and as a sequestrant preventing the interaction of hardness ions with surfactant. One specific alkali metal gluconate contemplated for use in the present invention is a gluconate such as sodium gluconate.

The cleaning composition of the present invention next comprises from about 0.3% to about 4%, alternatively from about 0.5% to about 2%, alternatively about 1% of nonionic fatty acid amides. The fatty acid amides used in the present cleaning composition have the general formula:

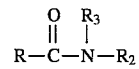

wherein R is the $C_5$–$C_{17}$ alkyl moiety of a fatty acid; $R_2$ is hydrogen, or an alkanol or iso-alkanol having from one to about six carbons, or a polyoxyethylene moiety having one to about five ethylene oxide groups; and $R_3$ is an alkanol or iso-alkanol having from one to about six carbons, or a polyoxyethylene having from one to about five ethylene oxide groups. An iso-alkanol is an alkanol wherein one or more alkyl groups are substituted for hydrogens on the primary carbon chain. Exemplary are the carboxylic amides recited in Kirk-Othmer *Encyclopedia of Chemical Technology,* (3d ed. 1983), vol. 22, pp. 373–77 (which are incorporated by reference here). More particularly, suitable nonionic fatty acid amides of the present invention include capric diethanolamide, cetyl-palmitic alkanolamides, coconut diethanolamide, coconut isopropanolamide, coconut monoethanolamide, lauric diethanolamide, lauric isopropanolamide, lauric monoethanolamide, or lauric-myristic diethanolamide, linoleic alkanolamides, myristic dietha-nolamide or monoethanolamide, oleic diethanolamide or monoethanolamide, stearic diethanolamide or monoethanolamide, tall oil alkanolamides, and mixtures thereof. The coconut ethanolamides, which are particularly suitable for the present invention, are fatty acid amides of coconut oil. Coconut oil is the- naturally occurring oil derived from coconuts which bears CAS registry number 8001-31-8. A commercially available source of the nonionic fatty acid amide is sold under the trademark Naetex C by Lanaetex Products Inc., Elizabeth, N.J.

The nonionic fatty acid amide of the present invention may act as a nonionic surfactant and enhances the total cleaning ability of the present cleaning composition. However, for purposes of quantifying the components of the present invention, the nonionic fatty acid amide is not a nonionic surfactant as defined herein and is not part of the disclosed weight percentage of nonionic surfactant.

The cleaning composition of the present invention comprises from about 0.3% to about 4%, alternatively from about 0.5% to about 2%, alternatively about 1%, of an iso-fatty acid. Any soluble iso-fatty acid is suitable for the present invention. Iso-fatty acids include fatty acids having a single methyl group substituted for a hydrogen on an otherwise straight-chain, unsubstituted fatty acid as well as fatty acids which are highly substituted with alkyl groups and have multiple branches. The contemplated iso-fatty acids have from about six to about sixteen carbon atoms, alternatively from about eight to about twelve carbon atoms, in the iso-fatty acid chain. 3,5,5-trimethylhexanoic acid is one iso-fatty acid specifically contemplated here.

The present invention comprises from about 2% to about 7%, alternatively from about 4% to about 6%, alternatively about 5%, of one or more builders. A builder is a substance that augments the cleaning effect of surfactants. One type of builder is a sequestering builder which acts to prevent hardness ions from interacting with the surfactant. Another type of builder is an alkaline builder which supplies alkalinity to the cleaning composition. Additional benefits may be achieved by including a builder in the cleaning composition of the present invention. Many forms of builders may act as both sequestering builders and alkaline builders within the same cleaning composition.

Sequestering builders augment the cleaning capability of surfactants by forming soluble chelates with hardness ions, thereby preventing hardness ions such as calcium and magnesium from interacting with surfactants. Nonsequestering precipitating builders such as carbonates may also prevent interaction with surfactants by forming insoluble precipitates with hardness ions. Suitable sequestering builders for the present invention include phosphates, phosphonates, nitrilotriacetates (NTAs), edetates or salts of EDTA, silicates, metasilicates, citrates, and polyacrylates.

The alkali metal phosphates that may be used as sequestering builders include the orthophosphates as well as the condensed or complex phosphates. The orthophosphates include monosodium, disodium and trisodium phosphate and monoammonium phosphate. The condensed or complex phosphates which may be used as sequestering builders include tetrasodium pyrophosphate, tetrapotassium pyrophosphate, disodium acid pyrophosphate, sodium hexametaphosphate, sodium tetraphosphate, and pentasodium tripolyphosphate. One example of a suitable NTA is trisodium NTA which is a powerful sequestering builder. The alkali metal or ammonium silicate builders that may be used include sodium metasilicate, sodium silicate, potassium silicate, sodium sequisilicate, and sodium orthosilicate.

Alkaline builders increase the alkalinity of the cleaning composition and act as a source of alkali metal ions, thereby facilitating the saponification of fatty acids and generally increasing the cleaning effectiveness of the composition. Alkaline builders include the alkali metal salts of carbonates, bicarbonates, borates, silicates, and metasilicates. The alkali metal or ammonium borate builders that may be used in the present invention include sodium metaborate, sodium tetraborate, potassium tetraborate, potassium pentaborate, and sodium perborate. The alkali metal or ammonium carbonate builders include anhydrous sodium carbonate, sodium sesquicarbonate, and sodium bicarbonate. The useful alkali metal hydroxides include sodium hydroxide, potassium hydroxide and lithium hydroxide. Suitable silicates and metasilicates are discussed above.

Additionally, certain builders may act as corrosion inhibiting agents if the cleaning composition is used on a metal surface. One builder contemplated for the present invention when corrosion of metal surfaces is a concern is sodium metasilicate.

The inclusion of a builder in the amounts disclosed in the present invention contributes the previously mentioned (and potentially other) benefits without significant detrimental effects such as making the cleaning composition corrosive under U.S. Department of Transportation regulations and the provisions of the Federal Hazardous Substances Act.

A commercially available source of a suitable builder is Metso Pentabead 20, a sodium metasilicate pentahydrate sold by the PQ corporation, Valley Forge, Pa.

The cleaning compositions of the invention have pH's of about 11 or more, and some effective embodiments may have pH's of about 13 while remaining "non-corrosive" under the previously mentioned regulations.

The present invention comprises from about 1% to about 15%, alternatively from about 4% to about 8%, alternatively about 6% of one or more glycol ethers. The invention contemplates the use of glycol ethers as organic solvents. The glycol ethers used in the present cleaning composition have the general formulas $$R_4—O—R_5—O—R_6$$

and $$R_4—O—R_5—O—R_7—O—R_6$$

wherein $R_4$ is hydrogen or an alkyl having from about one to about four carbon atoms; $R_5$ is an alkyl having from about one to about four carbon atoms; $R_6$ is an alkyl having from about one to about six carbon atoms; and $R_7$ is an alkyl having from about one to about four carbon atoms or an ether having from about two to about six carbon atoms. Some examples of useful glycol ethers are propylene glycol methyl ether, propylene glycol ethyl ether, propylene glycol propyl ether, dipropylene glycol methyl ether, tripropylene glycol methyl ether, dipropylene glycol ethyl ether, ethylene glycol methyl ether, ethylene glycol ethyl ether, ethylene glycol butyl ether, diethylene glycol methyl ether, diethylene glycol butyl ether, ethylene glycol dimethyl ether, ethylene glycol monobutyl ether, and others.

The cleaning composition of the invention comprises from about 1% to about 15%, alternatively from about 4% to about 6%, alternatively about 5%, of one or more nonionic surfactants. The nonionic surfactants contemplated for use in the present cleaning compositions are distinguishable from other types of surfactants (such as anionic or cationic surfactants) in that nonionic surfactants generally do not dissociate as ions in a working solution. Nonionic surfactants are primarily organic compounds having both hydrophilic and hydrophobic moieties. Suitable nonionic surfactants for the present invention include alkoxylated alcohols and alkoxylated ether phenols as well as the nonionic surfactants disclosed in Kirk-Othmer *Encyclopedia of Chemical Technology,* (3d ed. 1983), vol. 22, pp. 360–73 (which are incorporated by reference here).

The alkoxylated alcohols include ethoxylated, propoxylated, or ethoxylated and propoxylated alcohols having hydrophobic moieties comprised of carbon chains ranging in length from about six to about sixteen carbons, alternatively from about nine to about eleven carbon atoms.

The alcohol ethoxylates may be obtained as the reaction products of an alcohol and ethylene oxide and/or propylene oxide. The alkoxylated ether phenols include substituted phenols having carbon chain substituents from about six to about sixteen carbon atoms in length, alternatively from about nine to about eleven carbon atoms in the substituent chain. The hydrophilic moiety may be a polyoxyethylene group or a block or random co-oligomer (i.e., chain) of polyoxyethylene and polyoxypropylene moieties. In the present invention, the nonionic surfactants can have from about two to about ten moles of ethylene oxide, or from about one to about ten moles each of ethylene and propylene oxide per mole of alcohol or phenol, alternatively about six moles of ethylene oxide or about six moles each of ethylene and propylene oxide per mole of alcohol or phenol.

One type of nonionic surfactant suitable for the present invention is Neodol 91-6, which is a product of the Shell Chemical Company. An alternative to commercial purchase of the nonionic surfactant is its synthesis through base catalyzed ethoxylation of aliphatic alcohols, alkyl phenols and fatty acids.

Without intending to limit their invention, the inventors believe that a nonionic surfactant having a relatively small molecule, such as an alcohol ethoxylate having an alcohol chain length of from about 9 to about 11 carbon atoms and an ethoxylate chain length of about 6 ethylene oxide moieties, is particularly beneficial in a hard surface cleaner. During cleaning, a smaller molecule can be expected to diffuse to the oil/water interface faster than a larger molecule. A larger molecule may lower the surface tension to a greater degree than a smaller molecule at equilibrium. During cleaning, however, the oil/water interface is commonly expanding. A surfactant having a smaller molecule can be expected to deliver lower surface tension as the interface is expanding.

It is contemplated that any additional components which do not totally obviate cleaning ability may be added to the cleaning composition within the full scope of the present invention. Such additional components may be selected based upon a desire to impart color, fragrance, abrasive particles, or other characteristics to the composition.

The following examples, experiments and results provide a basis for understanding the nature of the invention and illustrate the superior cleaning ability of the invention over the prior art.

WORKING EXAMPLES

Testing Methodology

Hard surface cleaner efficacy tests were carried out as follows. The tests may be summarized as calculating the percentage of soil removed from a soiled steel panel through either an immersion technique or a spray technique.

Sludge was prepared by the following method, which is a modified version of that described in U.S. Pat. No. 4,161,452, col. 9, lines 5 through 20. A 1470 gram sample of Exxon 130 Neutral Oil (available from Exxon Company, U.S.A.) and a 30 gram sample of iron naphthenate, 6% solution (available from OM Group, Inc., Cleveland, Ohio) were combined in a 2000 ml reaction vessel. The reaction vessel was then placed into an aluminum heating mantle and securely covered. A thermometer was attached to the cover with a thermometer adaptor, and a Therm-O-Watch regulator was connected to the thermometer to maintain a temperature of 175° C. A glass tube was inserted through the thermometer adaptor and into the mixture so that a continuous air flow could be bubbled into the mixture. A connecting hose adaptor was placed into one of the cover ports to act as an exhaust. The heating mantle and air supply were then turned on, and the mixture was heated at 175° C. for 72 hours. The resultant oil/sludge was cooled to room temperature and vacuum filtered through a Buchner Funnel, #10-3566E, using Whatman filter paper #4.

Steel panels made of 1010 steel with a ground finish measuring 4 inches by 6 inches were provided. Suitable panels include Q-Panel No. S-46, available from the Q-Panel Company, of Cleveland, Ohio.

The unsoiled steel panels were weighed to the nearest milligram prior to the application of the sludge prepared by the above described method. The unsoiled weight was recorded as weight C. A universal applicator was set at a thickness of 2 mls and used to apply the sludge by drawing the applicator along the steel panel. The universal applicator was obtained from Paul N. Gardner Co., Inc., Pompano Beach, Fla. The soiled panel was reweighed and the weight was recorded as weight A.

The soiled steel panels were cleaned by immersing them in a cleaning solution to be tested. To clean using the immersion method, a Pyrex immersion tray measuring 11 inches by 7 inches by 1.5 inches (about 28 cm by about 17.8 cm by about 3.8 cm) was filled with 150 ml of a cleaning composition to be tested. A soiled panel was immersed in the cleaning composition for 10 minutes. For each soiled panel immersed, a clean sample of the cleaning composition was used. After the 10 minute immersion, the panel was rinsed with water for 30 seconds with water regulated to a flow of one gallon per minute. After this rinsing, the panel was dried for approximately 5 minutes in a gravity oven at 212° F. The panel was then cooled and its final weight, B, was measured and recorded.

The percentage of soil removed is calculated as follows:

$$\% \text{ soil removal} = [(A-B)/(A-C)] \times 100$$

where A equals the weight in grams of the panel and soil before cleaning, B equals the weight in grams of the panel and soil after cleaning, and C equals the weight in grams of the unsoiled panel.

Example A

The immersion method described above was used to test an embodiment of the cleaning composition of the present invention (Composition A). In Composition A, the alkali metal gluconate was the sodium salt of 1,2,3,4,5-pentahydroxypentanoic acid, the nonionic fatty acid amide was Naetex C, the iso-fatty acid was 3,5,5-trimethylhexanoic acid, the builder was sodium metasilicate, the glycol ether was 2-butoxyethanol, and the nonionic surfactant was Neodol 91-6. The proportions of these ingredients are set out in the Table.

Examples B through F (comparative)

To provide a performance comparison, several leading nationally/commercially available multipurpose cleaning compositions, B through F, were used to carry out the immersion tests set out above. The commercial cleaning products were purchased through normal consumer channels and their probable compositions were deduced analytically by employees of the assignee. Therefore, the compositions of these commercial cleaning products are only approximately known to the inventors.

TABLE 1

| | Composition of Tested Cleaners | | | | | |
|---|---|---|---|---|---|---|
| ROW | A | B | C | D | E | F |
| 1 | 82.05 | 85–88 | 93.5–95.5 | 89–92 | 90–95 | 84–87 |
| 2 | 5.88 | 3.2–4.2 | 2.6–4.9 | 4.5–5.5 | 3.3–6.5 | 5–7 |
| 3 | 4.95 | 0 | 0 | 0 | | 0 |
| 4 | 1.5 | 0 | 0 | | | 0 |
| 5 | 3.72 | 6–8 | 0.3–2.0 | 0.6–2.2 | 0.4–1.5 | 5.5–8 |
| 6 | 0.90 | | | | | |

TABLE 1-continued

| ROW | Composition of Tested Cleaners A | B | C | D | E | F |
|---|---|---|---|---|---|---|
| 7 | 1.00 | | | | | |
| 8 (posssible other ingredients) | | 0–5.8 | 0–3.6 | 0.3–5.9 | 0–6.3 | 0–5.5 |

TABLE 2

| | Cleaning Results of Tested Cleaners A | B | C | D | E | F |
|---|---|---|---|---|---|---|
| Average Amount of Soil (grams) | 0.664 | 0.554 | 0.646 | 0.668 | 0.300 | 0.541 |
| Average Amount of Soil Removed (grams) | 0.421 | 0.304 | 0.252 | 0.111 | 0.036 | 0.080 |
| Normalized Average Soil Removal (grams) | 0.19 | 0.16 | 0.12 | 0.05 | 0.04 | 0.04 |
| Average % Soil Removal | 67 | 55 | 45 | 16 | 13 | 10 |

In Table 1, Row 1 represents the percentage of the tested cleaning composition which is water. Row 2 is the percentage of the composition which is 2-butoxyethanol. Row 3 is the percentage which is silicates. Row 4 is the percentage of sodium gluconate. Row 5 is the percentage of nonionic surfactant. Row 6 is the percentage of nonionic fatty acid amide. Row 7 is the percentage of iso-fatty acid. Row 8 indicates the amount of possible additional ingredients. Ranges indicate uncertainty as to the amount of the ingredient present.

Table 2 discloses the average results from the Castrol Hard Surface Cleaners Efficacy Test for each of the tested cleaning compositions. The cleaning results for each composition are expressed in the Table as average grams of soil removed, normalized soil removal in grams and percentage sludge removal. These results consist of the average of measurements from several tests. As Table 2 indicates, Composition A which embodies the present invention provides superior cleaning performance by removing the highest percentage and the highest absolute amount based on normalized values as compared to the tested commercially available cleaning compositions, Compositions B through F. This markedly superior cleaning performance is an unexpected and beneficial result of the selection of the ingredients and proportions of the present invention.

The above specification, examples and data provide a basis for understanding and using the disclosed invention. However, any embodiment of the invention within the scope of the claims can be made without departing from the spirit and scope of the invention. The invention resides in the claims which follow.

I claim:

1. A cleaning composition comprising:

a. from about 0.4% to about 5% of an alkali metal gluconate;

b. from about 0.3% to about 4% of a nonionic fatty acid amide;

c. from about 0.3% to about 4% of an iso-fatty acid;

d. from about 2% to about 7% of a builder;

e. from about 1% to about 15% of a glycol ether;

f. from about 1% to about 15% of a nonionic surfactant which is different from said nonionic fatty acid amide; and g. from about 50% to about 95% of water.

2. The composition of claim 1, wherein said alkali metal gluconate is sodium gluconate.

3. The composition of claim 1, comprising from about 0.5% to about 5% of said alkali metal gluconate.

4. The composition of claim 1, comprising from about 1% to about 2% of said alkali metal gluconate.

5. The composition of claim 1, comprising about 1.5% of said alkali metal gluconate.

6. The composition of claim 1, wherein said nonionic fatty acid amide is a lower-alkanol amide of a coconut fatty acid.

7. The composition of claim 1, wherein said nonionic fatty acid amide is an ethanolamide of a coconut fatty acid.

8. The composition of claim 1, comprising from about 0.4% to about 4% of said nonionic fatty acid amide.

9. The composition of claim 1, comprising from about 0.5% to about 2% of said nonionic fatty acid amide.

10. The composition of claim 1, comprising about 1% of said nonionic fatty acid amide.

11. The composition of claim 1, wherein said iso-fatty acid is 3,5,5-trimethylhexanoic acid.

12. The composition of claim 1, comprising from about 0.4% to about 4% of said iso-fatty acid.

13. The composition of claim 1, comprising from about 0.5% to about 2% of said iso-fatty acid.

14. The composition of claim 1, comprising about 1% of said iso-fatty acid.

15. The composition of claim 1, wherein said builder is an alkali metal or ammonium salt of an anion selected from the group consisting of phosphate, silicate, metasilicate, carbonate or borate.

16. The composition of claim 1, wherein said builder is an alkali metal metasilicate.

17. The composition of claim 1, wherein said builder is sodium metasilicate.

18. The composition of claim 1, wherein said glycol ether is a water soluble $C_1$ to $C_4$ alkyl glycol ether.

19. The composition of claim 1, wherein said glycol ether is 2-butoxyethanol.

20. The composition of claim 1 comprising from about 4% to about 8% of glycol ether.

21. The composition of claim 1 comprising from about 5% to about 7% of glycol ether.

22. The composition of claim 1, wherein said nonionic surfactant is an alcohol ethoxylate.

23. The composition of claim 1, wherein said nonionic surfactant is an alcohol ethoxylate having an alcohol chain length from about 9 to about 11 carbon atoms.

24. The composition of claim 1, wherein said nonionic surfactant is the reaction product of an alcohol and ethylene oxide, said reaction product having an average of about 6 moles of ethylene oxide per mole of alcohol.

25. The composition of claim 1, wherein said nonionic surfactant is a nonylphenol ethoxylate.

26. The composition of claim 1, wherein said nonionic surfactant is an alcohol ethoxylate and is present at about 5%.

27. The composition of claim 1, having a pH of at least about 11.

* * * * *